US009291440B2

(12) United States Patent
Ardiff et al.

(10) Patent No.: US 9,291,440 B2
(45) Date of Patent: Mar. 22, 2016

(54) VACUUM PANELS USED TO DAMPEN SHOCK WAVES IN BODY ARMOR

(71) Applicant: Honeywell International Inc., Morristown, NJ (US)

(72) Inventors: Henry Gerard Ardiff, Chesterfield, VA (US); Lori L. Wagner, Richmond, VA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 336 days.

(21) Appl. No.: 13/803,521

(22) Filed: Mar. 14, 2013

(65) Prior Publication Data

US 2014/0260933 A1 Sep. 18, 2014

(51) Int. Cl.
*F41H 5/04* (2006.01)
*F42D 5/05* (2006.01)

(52) U.S. Cl.
CPC ..... *F42D 5/05* (2013.01); *F41H 5/0464* (2013.01); *Y10T 29/49826* (2015.01)

(58) Field of Classification Search
CPC .... F41H 5/0464; F42D 5/05; Y10T 29/49826
See application file for complete search history.

(56) References Cited

U.S. PATENT DOCUMENTS 4,579,756 A 4/1986 Edgel
4,718,958 A 1/1988 Kugelmann, Sr.
4,888,073 A 12/1989 Kugelmann
5,271,980 A 12/1993 Bell
5,756,179 A 5/1998 Jutte
5,788,907 A * 8/1998 Brown et al. ..... 264/280
5,792,539 A 8/1998 Hunter
5,943,876 A 8/1999 Meyer et al.
6,341,708 B1 1/2002 Palley et al.
7,562,507 B2 7/2009 Fleming
7,601,654 B2 10/2009 Bhatnagar et al.
7,762,175 B1 7/2010 Bhatnagar et al.
7,930,966 B1 4/2011 Bhatnager et al.
7,968,159 B2 6/2011 Feinerman
8,137,784 B2 3/2012 Veltkamp
2005/0144904 A1 7/2005 Veltkamp
2009/0136702 A1 5/2009 Gu
2010/0005556 A1 1/2010 Pittman et al.
2010/0236393 A1 9/2010 Martin et al.
2012/0148785 A1 6/2012 Hsu et al.
2012/0196147 A1 8/2012 Rabiei
2012/0234164 A1 9/2012 Kucherov et al.

OTHER PUBLICATIONS

International Search Report and Written Opinion of the International Searching Authority for Corresponding Application PCT/US2014/022206.

* cited by examiner

*Primary Examiner* — Anna Kinsaul
(74) *Attorney, Agent, or Firm* — Roberts & Roberts, LLP; Richard S. Roberts, Jr.

(57) ABSTRACT

Ballistic resistant composite articles having improved resistance to backface deformation. The composite articles incorporate one or more vacuum panels that mitigate or eliminate shock wave energy resulting from a projectile impact to minimize transient compression of materials behind the armor.

20 Claims, 7 Drawing Sheets

VACUUM PANELS USED TO DAMPEN SHOCK WAVES IN BODY ARMOR

BACKGROUND

1. Technical Field

This technology relates to ballistic resistant composite articles having improved resistance to backface deformation.

2. Description of the Related Art

The two primary measures of anti-ballistic armor performance are projectile penetration resistance and blunt trauma ("trauma") resistance. A common characterization of projectile penetration resistance is the $V_{50}$ velocity, which is the experimentally derived, statistically calculated impact velocity at which a projectile is expected to completely penetrate armor 50% of the time and be completely stopped by the armor 50% of the time. For composites of equal areal density (i.e. the weight of the composite panel divided by the surface area) the higher the $V_{50}$ the better the penetration resistance of the composite. Whether or not a high speed projectile penetrates armor, when the projectile engages the armor, the impact also deflects the body armor at the area of impact, potentially causing significant non-penetrating, blunt trauma injuries. The measure of the depth of deflection of body armor due to a bullet impact is known as backface signature ("BFS"), also known in the art as backface deformation or trauma signature. Potentially resulting blunt trauma injuries may be as deadly to an individual as if the bullet had fully penetrated the armor and entered the body. This is especially consequential in the context of helmet armor, where the transient protrusion caused by a stopped bullet can still cross the plane of the skull underneath the helmet and cause debilitating or fatal brain damage. Accordingly, there is a need in the art for a method to produce ballistic resistant composites having both superior $V_{50}$ ballistic performance as well as low backface signature.

It is known that the impact of a high speed projectile with ballistic-resistant armor generates and propagates a compression wave. This compression wave, i.e. a shock wave, propagates outward from the point of impact, causing a transient compression behind the armor. This transient compression often extends beyond the deformation of the armor itself and may be a significant contributor to the resulting depth of backface deformation, causing great blunt trauma. Limiting or mitigating the shock wave energy, or even preventing formation of the shock wave entirely, would effectively reduce the extent of backface deformation.

One method for limiting the effect of a shock wave is by absorbing it. For example, U.S. patent application publication 2012/0234164 teaches a system including a fracture layer comprising an outer ceramic layer, a fracture material that disintegrates into fine particles when it absorbs a shock wave, and a plurality of resonators embedded within the fracture material. The ceramic layer accelerates and spreads out a shock wave generated by a projectile impact, the fracture material absorbs the shock wave which causes it to pump high energy acoustic wave energy, and the resonators reflect this wave energy generated in the fracture layer. This system employs an approach that is counterintuitive to the approach described herein, amplifying the shock wave rather than mitigating it so that the wave has sufficient energy to activate vibrations at particular acoustic spectral line wavelengths.

U.S. patent application publication 2009/0136702 teaches a transparent armor system for modifying the shock wave propagation pattern and subsequent damage pattern of transparent armor such as bullet-resistant glass. They describe the incorporation of a non-planar interior layer positioned between two armor layers. The non-planar interface design of the interior layer modifies the shock wave pattern through geometric scattering and material sound impedance mismatch induced scattering. This type of structure is designed to allow distribution of the impact energy into preferred areas of the armor without causing significant glass shattering and spalling. This system is not directed to body armor.

Other systems are known that employ blast mitigating materials such as aerospace-grade honeycomb materials or blast mitigating foams to suppress shock waves and reduce the impact of high pressure blast energy. Aerospace-grade honeycomb materials are generally characterized as a panel of closely packed geometric cells. It is a structural material that is commonly employed in composites forming structural members in aircraft and vehicles because of their high strength, superior structural properties and versatility, but they are also known for use in ballistic resistant composites. See, for example, U.S. Pat. No. 7,601,654 which teaches rigid ballistic resistant structures comprising a central honeycomb panel positioned between two rigid, ballistic resistant fibrous panels. Blast mitigating foams are useful because they can absorb heat energy from a blast and can collapse and absorb energy by virtue of their viscoelastic properties. Condensable gases in foams may condense under elevated pressure, thereby liberating heat of condensation to the aqueous phase and causing a decrease in shock wave velocity. See, for example, U.S. Pat. No. 6,341,708 which teaches blast resistant and blast directing container assemblies for receiving explosive articles and preventing or minimizing damage in the event of an explosion. The container assemblies are fabricated from one or more bands of a blast resistant material, and are optionally filled with a blast mitigating foam.

These articles of the related art are all limited in their usefulness. They are not optimized for limiting or eliminating shock wave energy while maintaining superior ballistic penetration resistance to high speed projectiles and while also maintaining a low weight that is sufficient for body armor applications. The articles described in both U.S. 2009/0136702 and U.S. 2012/0234164 are heavy, non-fibrous composites that are predominantly used for bullet resistant glass applications. Articles incorporating honeycomb structures are bulky, heavy and not optimized for use in body armor. Articles incorporating blast mitigating foams also have limited effectiveness in body armor applications.

In view of these drawbacks, there is an ongoing need in the art for improved armor solutions that are useful in a wide range of applications, including but not limited to body armor applications. The present system provides a solution to this need in the art.

SUMMARY OF THE INVENTION

An improved system is provided that utilizes vacuum panel technology in combination with high performance ballistic resistant composites to form lightweight articles having all of the desired benefits described herein.

Provided is a ballistic resistant article comprising: a) a vacuum panel having first and second surfaces, said vacuum panel comprising an enclosure and an interior volume defined by the enclosure, wherein at least a portion of said interior volume is unoccupied space and wherein said interior volume is under vacuum pressure; and b) at least one ballistic resistant substrate directly or indirectly coupled with at least one of said first and second surfaces of said vacuum panel, said substrate comprising fibers and/or tapes having a tenacity of about 7 g/denier or more and a tensile modulus of about 150 g/denier or more.

Also provided is a ballistic resistant article comprising: a) a vacuum panel having first and second surfaces, said vacuum panel comprising an enclosure and an interior volume defined by the enclosure, wherein at least a portion of said interior volume is unoccupied space and wherein said interior volume is under vacuum pressure; and b) at least one ballistic resistant substrate directly or indirectly coupled with at least one of said first and second surfaces of said vacuum panel, said substrate comprising a rigid, non-fiber based, non-tape based material.

Further provided is a method of forming a ballistic resistant article which comprises: a) providing a vacuum panel having first and second surfaces, said vacuum panel comprising an enclosure and an interior volume defined by the enclosure, wherein at least a portion of said interior volume is unoccupied space and wherein said interior volume is under vacuum pressure; and b) coupling at least one ballistic resistant substrate with at least one of said first and second surfaces of said vacuum panel, said substrate comprising fibers and/or tapes having a tenacity of about 7 g/denier or more and a tensile modulus of about 150 g/denier or more, or wherein said substrate comprises a rigid, non-fiber based, non-tape based material; wherein said at least one ballistic resistant substrate is positioned as the strike face of the ballistic resistant article and said vacuum panel is positioned behind said at least one ballistic resistant substrate to receive any shock wave that initiates from an impact of a projectile with said at least one ballistic resistant substrate.

DETAILED DESCRIPTION

It is known that a shock wave cannot travel through a vacuum. The invention employs vacuum panel technology in conjunction with ballistic resistant armor to mitigate the effect of shock waves generated by a projectile impact. The articles are particularly effective for reducing the extent of backface deformation and avoiding or minimizing blunt trauma injuries.

Figure 1:
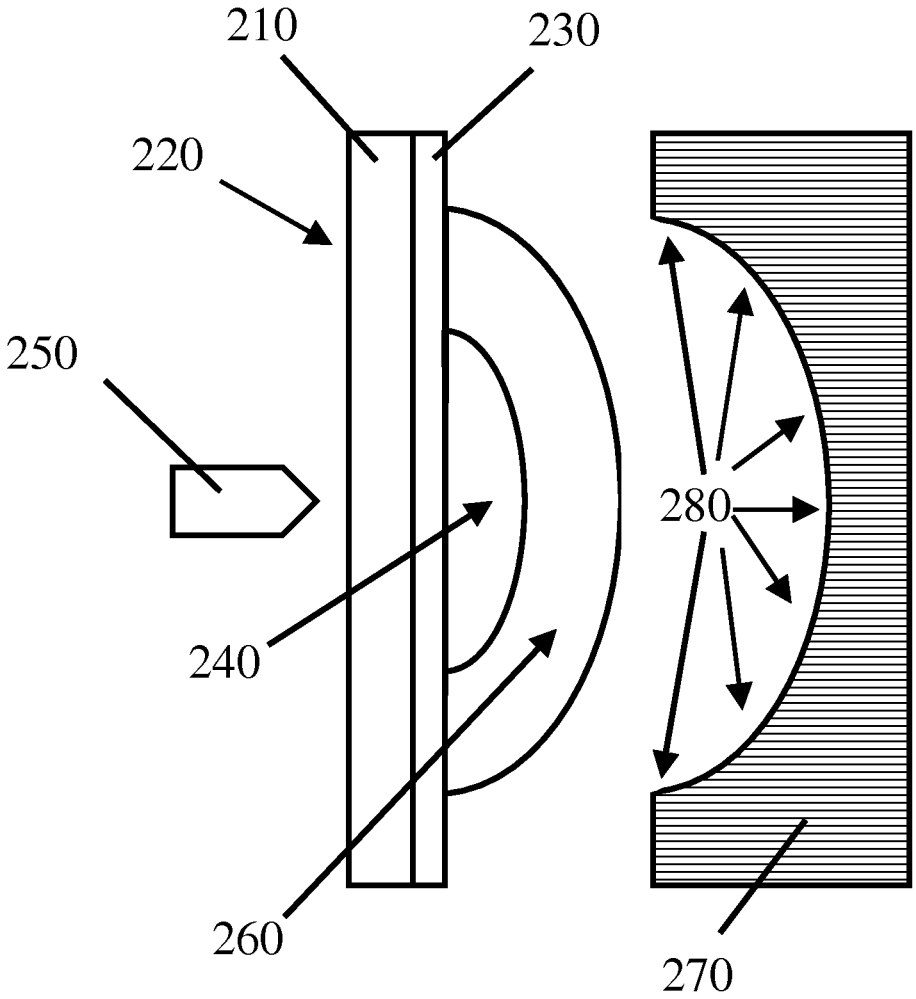
FIG. 1 (PRIOR ART)
FIG. 1 is a perspective view schematic representation illustrating the effect of a shock wave on backface signature in a clay backing material for a prior art armor structure that does not incorporate a vacuum panel.
Figure 2:
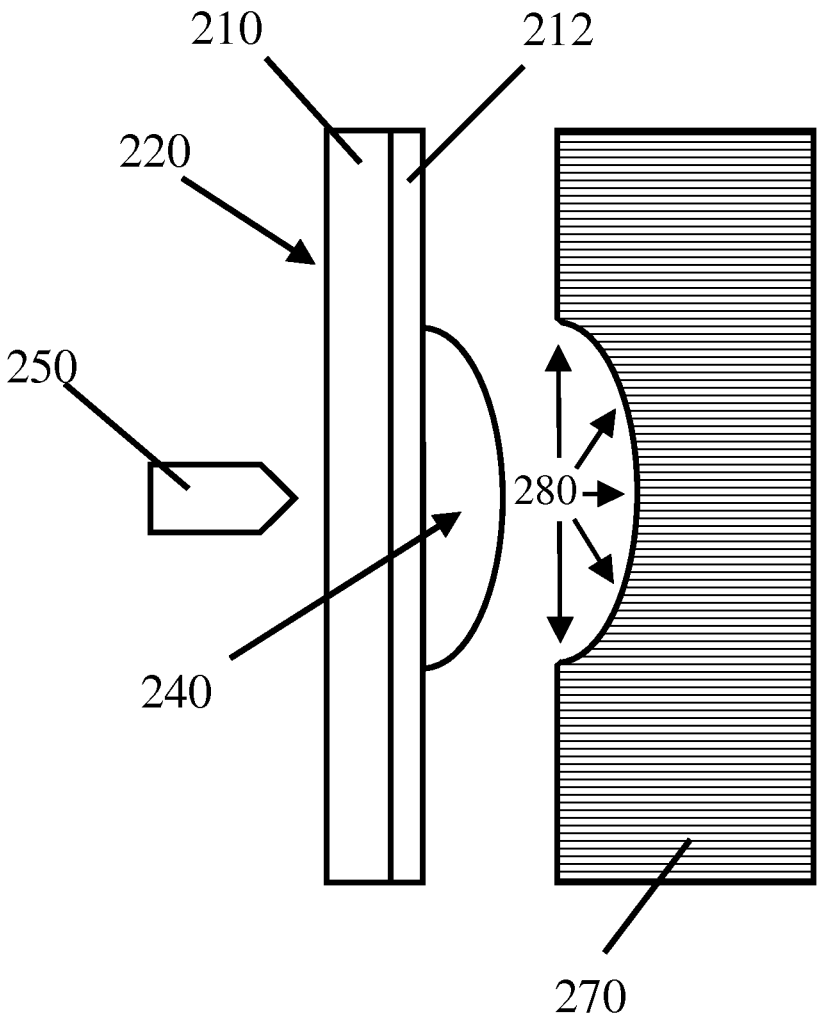
FIG. 2 is a perspective view schematic representation illustrating a reduction in backface signature in a clay backing material due to shock wave suppression resulting from the incorporation of a vacuum panel in an armor structure.

FIGS. 1 and 2 serve to illustrate the significance of the backface deformation reduction due when the inventive construction is employed. FIG. 1 illustrates how the impact of a bullet 250 on the strike face 220 of a ballistic resistant substrate 210 causes a post-impact transient deformation 240 and a post-impact shock wave 260. The figure schematically illustrates the effect of the post-impact shock wave 260 on backface signature 280 in a clay backing material 270 for a prior art armor structure that incorporates a conventional backing material 230 (such as honeycomb material or a foam) rather than a vacuum panel of the invention. This is contrasted with FIG. 2, which illustrates an armor construction of the invention. The figure schematically illustrates how the attachment of a vacuum panel 212 backing material to the back of a ballistic resistant substrate 210 eliminates the shock wave and the resulting decrease in backface signature 280.

Vacuum panel technology is known from other industries unrelated to armor, primarily as insulation and sound proofing materials in building and home construction. Generally, any known vacuum panel construction having an interior volume that is under vacuum pressure is useful herein provided that at least a portion of its interior volume is unoccupied. Preferred are vacuum panels having interior volumes that are predominantly unoccupied space, and most preferred vacuum panels have interior volumes that are substantially unoccupied space. As used herein, "unoccupied space" describes the presence of physical supporting materials or structures within the internal volume of the vacuum panel. It does not refer to the quality of the vacuum or to an amount of gas present within the internal volume of the vacuum panel. As used herein, "predominantly unoccupied space" means that greater than 50% of the interior volume of a vacuum chamber within a vacuum panel is unoccupied space, wherein any remainder of the interior volume is taken up by supporting structures or filler materials. As used herein, "substantially unoccupied space" means that at least about 80% of the interior volume of a vacuum chamber within a vacuum panel is unoccupied space, wherein any remainder of the interior volume is taken up by supporting structures or filler materials, and more preferably wherein at least about 90% of the interior volume is unoccupied space. Most preferably, 100% of the interior volume of a vacuum chamber within a vacuum panel is unoccupied space. A vacuum panel having 100% of the interior volume of its vacuum chamber being unoccupied space would necessarily have walls fabricated from a rigid material that was capable of retaining its shape while under vacuum. In applications such as body armor where flexibility and low weight are desired, it is preferred that the vacuum panel walls be fabricated from a lightweight, non-rigid flexible material, which would necessarily have a supporting structure within the interior volume to prevent the panel walls from collapsing under the vacuum. In this embodiment, it is preferred that this interior supporting structure comprises only a minimal amount of the interior volume, preferably comprising no greater than about 20% of the volume so that at least about 80% of the vacuum panel is unoccupied space.

The unoccupied space within each vacuum panel is at least partially evacuated of gas molecules to form a vacuum. Ideally, the unoccupied space is completely evacuated of gas molecules to achieve an absolute pressure of zero torr, where the unoccupied space within the internal volume consists entirely of empty, void space. However, the compete evacuation of gas molecules, known as a perfect vacuum, is not required to meet the definition of a vacuum. A vacuum is defined as an absolute pressure of less than 760 torr. Therefore, as used herein, the interior volume of a vacuum panel is under vacuum pressure when the absolute pressure of the interior volume is less than 760 torr. For maximum mitigation of shock wave energy, it is preferred that the interior volumes of the vacuum panels are evacuated to the lowest possible pressure. In preferred embodiments, at least 90% of gases are evacuated from the vacuum panels, resulting in an internal pressure of about 76 torr or less. More preferably, at least 95% of gases are evacuated from the vacuum panels, resulting in an internal pressure of about 38 torr or less. Still more preferably, at least 99% of gases are evacuated from the vacuum panels, resulting in an internal pressure of about 8 torr or less. In the most preferred embodiments, the vacuum panels have an internal pressure of about 5 torr or less, more preferably about 4 torr or less, more preferably about 3 torr or less, more preferably about 2 torr or less, and still more preferably about 1 torr or less. All pressure measurements identified herein refer to absolute pressure. If the articles of the invention include multiple vacuum panels, the internal pressure of all the panels may be the same or the pressures may vary.

Figure 3:
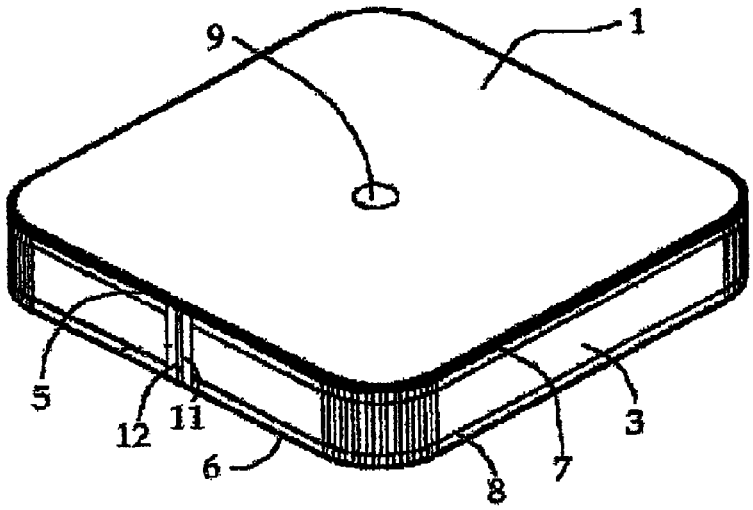
FIG. 3 (PRIOR ART)
FIG. 3 is a perspective view schematic representation of a prior art vacuum panel.

Useful vacuum panels preferably have a generally rectangular or square shape, but other shapes may be equally employed and vacuum panel shape is not intended to be limiting. Useful vacuum panels are commercially available. The vacuum panel preferably comprises a first surface (or first wall), a second surface (or second wall) and optionally one or more side walls that together form an enclosure, with an interior volume being defined by the enclosure. A vacuum is created inside the panel by evacuating any gases present in the interior volume, typically through an opening located in one of the first or second surfaces or one of the optional side walls. An exemplary vacuum panel from the prior art that is useful herein is illustrated in FIG. 3 and is described in detail in U.S. Pat. No. 8,137,784 assigned to Level Holding B.V. of The Netherlands, the disclosure of which is incorporated herein by reference to the extent consistent herewith. U.S. Pat. No. 8,137,784 describes a vacuum insulation panel formed by an upper main wall 1 and a lower main wall 2 (not shown in FIG. 3), wherein both main walls are mutually connected by a metal foil 3 extending all around. The metal foil 3 is welded to a bent skirt 5 of upper main wall 1 and a bent skirt 6 of lower main wall 2. Strips 7 and 8 improve the quality of the weld between the bent skirts 5 and 6, respectively, with the metal foil 3. Gases inside the panel are removed through an opening arranged in the upper main wall 1 and the opening is then closed with a cover plate 9 that is welded onto the upper main wall 1. U.S. Pat. No. 8,137,784 describes that their panel walls are fabricated from a thin, low conduction metal, such as stainless steel, titanium or an appropriate alloy. However, for the purposes of the present invention, the materials used to fabricate the vacuum panel are not so limited and may be anything known in the art of vacuum insulation panels.

Figure 4:
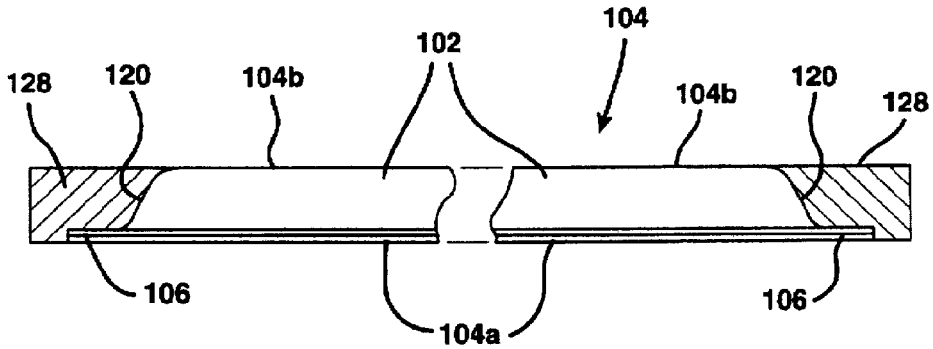
FIG. 4 (PRIOR ART)
FIG. 4 is a perspective view schematic representation of a prior art vacuum panel.

Another exemplary vacuum panel from the prior art that is useful herein is illustrated in FIG. 4 and is described in detail in U.S. Pat. No. 5,756,179 assigned to Owens-Corning Fiberglas Technology Inc. of Summit, Ill., the disclosure of which is incorporated herein by reference to the extent consistent herewith. U.S. Pat. No. 5,756,179 describes a vacuum panel 102 that comprises a jacket 104 including a top 104a and a bottom 104b. The jacket 104 is formed of a metal such as 3 mil stainless steel. The bottom 104b is formed into a pan shape having side edges 120, a cavity for receiving an insulating media, and a flat flange 106 extending around its periphery. The flat flange 106 is welded to top 104a to form a hermetic seal, and the enclosure formed thereby is evacuated to create a vacuum inside the enclosure. Preformed edge inserts 128 shown in FIG. 4 are present to engage adjacent vacuum insulation panels in a multi-panel construction.

Figure 5:
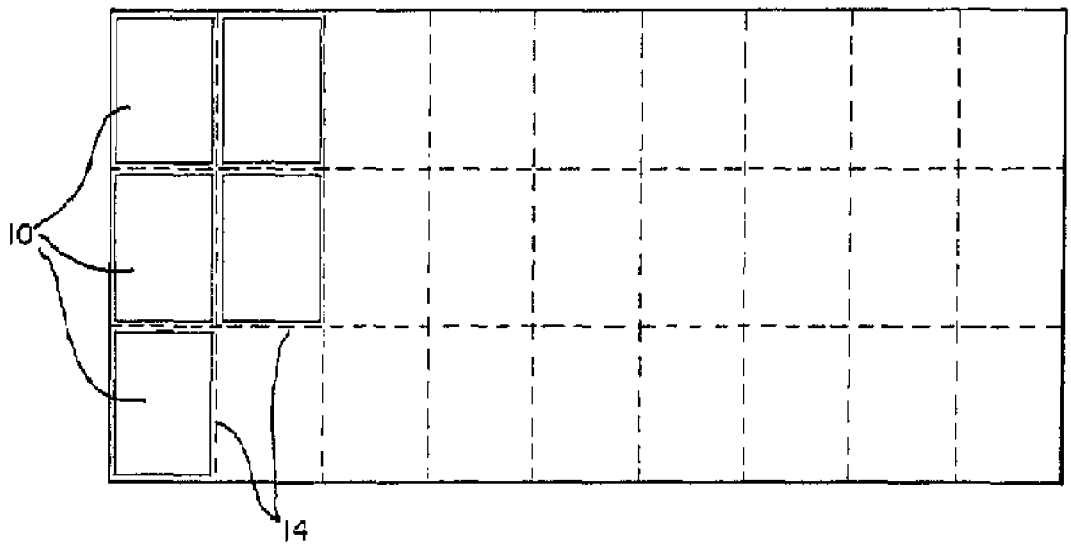
FIG. 5 (PRIOR ART)
FIG. 5 is a perspective view schematic representation of a prior art vacuum panel sheet structure where a plurality of vacuum compartments are interconnected with each other to form a sheet with perforations between adjacent panels.

U.S. Pat. No. 4,579,756 discloses a prior art vacuum panel sheet structure made of a plurality of air tight chambers having a partial vacuum therein. The insulating sheet structure of U.S. Pat. No. 4,579,756 is illustrated in FIG. 5 wherein a plurality of vacuum compartments 10 are interconnected with each other to form a sheet.

The sheet is scored to create perforations 14 between adjacent panels. The sheet may be torn and separated at the perforations, allowing the size of the sheet to be customized by the user. Any type of compartmentalized vacuum panel structure having a plurality of discrete vacuum panels in side-by-side or edge-to-edge configuration are preferred to help the vacuum panel survive multiple projectile impacts.

A number of other vacuum panel structures are known in the art and also can be used in the present invention. See, for example, U.S. Pat. Nos. 4,718,958; 4,888,073; 5,271,980; 5,792,539; 7,562,507 and 7,968,159, as well as U.S. patent application publication 2012/0058292, all of which are incorporated by reference herein to the extent compatible herewith.

The dimensions of the vacuum panels and the materials used to fabricate the panels may vary depending on the intended end use of the ballistic resistant composite armor. For example, body armor articles should be lightweight, so vacuum panels fabricated from lightweight materials are desired. When the intended use is not body armor, such as armor used for reinforcing vehicles or building walls, low weight is not as important and heavier materials may be desired. In each application, useful fabricating materials are well known and optimal panel construction would be readily determined by one skilled in the art.

In a preferred embodiment where the intended end use of the ballistic resistant article is a body armor application, the vacuum panel (or panels) preferably comprises a sealed, flexible polymeric envelope. A suitable polymeric envelope is preferably formed from overlapped and sealed polymeric sheets and may comprise a single or multilayer film structure. Suitable polymers for said polymeric sheets may vary and may comprise, for example, polyolefins or polyamides, such as described in U.S. Pat. No. 4,579,756, U.S. Pat. No. 5,943,876 or U.S. patent application publication 2012/0148785, which are incorporated herein by reference to the extent consistent herewith. As described in U.S. Pat. No. 5,943,876, it is preferred that such a polymeric envelope structure comprises at least one layer of a barrier film which minimizes permeation of gas to preserve the vacuum. An exemplary multilayer film comprises one or more heat sealable polymer layers, one or more polyethylene terephthalate (PET) layers, one or more polyvinylidene chloride layers and one or more polyvinyl alcohol layers. Other polymeric envelopes may be metallized with aluminum, aluminum oxide or laminated with a metallic foil to provide gas barrier properties. These options are only exemplary and are non-exclusive, and such constructions are well known in the art of vacuum panels. Incidentally, the incorporation of a metallic foil layer coupled with at least one of the first and second surfaces of the vacuum panel may also have the secondary benefit of partially reflecting part of the shock wave energy. Such a foil layer would comprise any known useful metallic foil, such as an aluminum foil, copper foil or nickel foil as determined by one skilled in the art.

U.S. patent application publication 2012/0148785 teaches vacuum panels comprising a polymeric envelope comprising a heat-seal layer including very low density polyethylene (VLDPE), low density polyethylene (LDPE), linear low density polyethylene (LLDPE), high density polyethylene (HDPE), metallocene polyethylene (mPE), metallocene linear low density polyethylene (mLLDPE), ethylene vinyl acetate (EVA) copolymer, ethylene-propylene (EP) copolymer or ethylene-propylene-butene (EPB) terpolymer, and a gas-barrier layer formed on the heat-seal layer, wherein the gas-barrier layer includes a plurality of composite layers, each including a polymer substrate and a single layer or multiple layers of metal or oxide thereof which is formed on one side or both sides of the polymer substrate, and the polymer substrate includes uniaxial-stretched or biaxial-stretched polyethylene terephthalate (PET), polybutylene terephthalate (PBT), polyimide (PI), ethylene/vinyl alcohol (EVOH) copolymer or a combination thereof.

Sheet thickness and overall panel dimensions will also vary as would be determined by one skilled in the art for the anticipated end use. It is expected that vacuum panels having a deep interior volume will be more effective at mitigating shock waves compared to a vacuum panel having a shallow interior volume. However, it has been unexpectedly found that vacuum panels having a depth of as little as ¼ inch (0.635 cm) are effective for reducing shock wave energy due to a projectile impact, depending on factors such as projectile energy, and/or projectile mass and/or projectile velocity, as well as the compaction fraction of the vacuum panel. Vacuum panels having a high compaction fraction are desirable because a projectile impact will press the armor strike face into the vacuum panel, causing the front surface of the vacuum panel directly adjacent to the substrate to press into the interior space of the panel and toward the rear surface of the panel. Vacuum panels having a high compaction fraction will resist this displacement and prevent the front panel surface from impacting the rear surface, which may generate another shock wave. Accordingly, preferred vacuum panel depths will vary.

Figure 6:
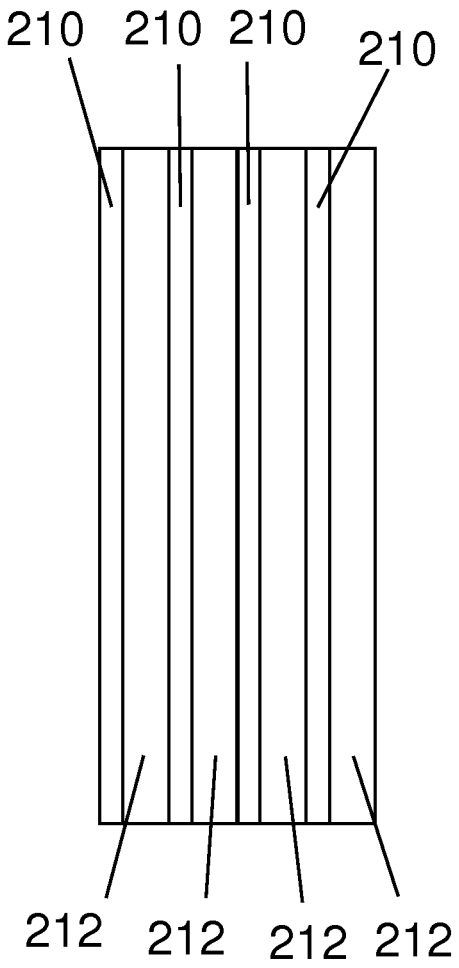
FIG. 6 is a perspective view schematic representation of a composite armor structure incorporating multiple, alternating ballistic resistant substrates and multiple vacuum panels.

It may also be expected that in some instances the impact of a projectile may damage or destroy the vacuum panel, thereby reducing the effectiveness of the armor article against multiple projectile impacts. Therefore, it is most preferred that the composite articles of the invention include a plurality of vacuum panels. In one preferred embodiment, an article incorporates a plurality of panels positioned next to each other in a side-by-side or edge-to-edge configuration, such as a sheet of vacuum panels of the prior art as illustrated in FIG. 5. This prior art structure includes perforations between panels to permit easy customization of the length and width of the sheet. In another preferred embodiment as illustrated in FIG. 6, an article incorporates a plurality of vacuum panels 212 stacked together in a front-to-back sequence, preferably alternating with a plurality of ballistic resistant substrates 210. Articles of this embodiment provide a cascade of protection, retaining protection against shock waves across the full length and width of an armor article even if one of the vacuum panels is destroyed by a projectile impact.

As illustrated in FIGS. 2 and 6-8, the ballistic resistant articles of the invention include at least one ballistic resistant substrate coupled with at least one of the first and second surfaces of each vacuum panel. The at least one ballistic resistant substrate may be directly or indirectly coupled with at least one of the first and second surfaces of each vacuum panel. Direct coupling refers to the direct attachment of a surface of the ballistic resistant substrate to a surface of a vacuum panel, such as with an adhesive, such that there is no space between the substrate and panel. Indirect coupling refers to an embodiment where a ballistic resistant substrate and a vacuum panel are joined together at one or more of their surfaces with a connector instrument such that the surfaces do not directly touch each other. Indirect coupling also includes embodiments where a vacuum panel is merely incorporated into an armor article without the vacuum panel and ballistic resistant substrate touching each other or even being attached or connected to each other by any means. In this regard, the invention encompasses any armor design including a vacuum panel.

For the purposes of the invention, a ballistic resistant substrate is a material that exhibits excellent properties against the penetration of deformable projectiles, such as bullets, and against penetration of fragments, such as shrapnel and spall. A "fiber layer" as used herein may comprise a single-ply of unidirectionally oriented fibers, a plurality of interconnected but non-consolidated plies of unidirectionally oriented fibers, a plurality of interconnected but non-consolidated woven fabrics, a plurality of consolidated plies of unidirectionally oriented fibers, a woven fabric, a plurality of consolidated woven fabrics, or any other fabric structure that has been formed from a plurality of fibers, including felts, mats and other structures, such as those comprising randomly oriented fibers. A "layer" describes a generally planar arrangement. A fiber layer will have both an outer top/front surface and an outer bottom/rear surface. A "single-ply" of unidirectionally oriented fibers comprises an arrangement of substantially non-overlapping fibers that are aligned in a unidirectional, substantially parallel array. This type of fiber arrangement is also known in the art as a "unitape", "unidirectional tape", "UD" or "UDT." As used herein, an "array" describes an orderly arrangement of fibers or yarns, which is exclusive of woven fabrics, and a "parallel array" describes an orderly parallel arrangement of fibers or yarns. The term "oriented" as used in the context of "oriented fibers" refers to the alignment of the fibers. The term "fabric" describes structures that may include one or more fiber plies, with or without molding or consolidation of the plies. For example, a woven fabric or felt may comprise a single fiber ply. A non-woven fabric formed from unidirectional fibers typically comprises a plurality of fiber plies stacked on each other and consolidated. When used herein, a "single-layer" structure refers to any monolithic fibrous structure composed of one or more individual plies or individual layers that have been merged, i.e. consolidated by low pressure lamination or by high pressure molding, into a single unitary structure, optionally together with a polymeric binder material. By "consolidating" it is meant that a polymeric binder material together with each fiber ply is combined into a single unitary layer. Consolidation can occur via drying, cooling, heating, pressure or a combination thereof. Heat and/or pressure may not be necessary, as the fibers or fabric layers may just be glued together, as is the case in a wet lamination process. The term "composite" refers to combinations of fibers or tapes, typically with at least one polymeric binder material. A "complex composite" refers to a consolidated combination of a plurality of fiber layers. As described herein, "non-woven" fabrics include all fabric structures that are not formed by weaving. For example, non-woven fabrics may comprise a plurality of unitapes that are at least partially coated with a polymeric binder material, stacked/overlapped and consolidated into a single-layer, monolithic element, as well as a felt or mat comprising non-parallel, randomly oriented fibers that are preferably coated with a polymeric binder composition.

The ballistic resistant substrate preferably comprises one or more layers, each layer comprising a plurality of high-strength, high tensile modulus polymeric fibers and/or non-fibrous high-strength, high tensile modulus polymeric tapes. As used herein, a "high-strength, high tensile modulus" fiber or tape is one which has a preferred tenacity of at least about 7 g/denier or more, a preferred tensile modulus of at least about 150 g/denier or more, and preferably an energy-to-break of at least about 8 J/g or more, each as measured by ASTM D2256 for fibers and ASTM D882 (or another suitable method as determined by one skilled in the art) for polymeric tapes. As used herein, the term "denier" refers to the unit of linear density, equal to the mass in grams per 9000 meters of fiber/yarn or tape. As used herein, the term "tenacity" refers to the tensile stress expressed as force (grams) per unit linear density (denier) of an unstressed specimen. The "initial modulus" of a fiber or tape is the property of a material representative of its resistance to deformation. The term "tensile modulus" refers to the ratio of the change in tenacity, expressed in grams-force per denier (g/d) to the change in strain, expressed as a fraction of the original fiber or tape length (in/in).

In embodiments where the ballistic resistant substrate is a fibrous, fiber-based material, particularly suitable high-strength, high tensile modulus fibers include polyolefin fibers, including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzoxazole (PBO) fibers, polybenzothiazole (PBT) fibers, liquid crystal copolyester fibers, rigid rod fibers such as M5® fibers, and glass fibers, including electric grade fiberglass (E-glass; low alkali borosilicate glass with good electrical properties), structural grade fiberglass (S-glass; a high strength magnesia-alumina-silicate) and resistance grade fiberglass (R-glass; a high strength alumino silicate glass without magnesium oxide or calcium oxide). Each of these fiber types is conventionally known in the art. Also suitable for producing polymeric fibers are copolymers, block polymers and blends of the above materials.

The most preferred fiber types include polyethylene, particularly extended chain polyethylene fibers, aramid fibers, PBO fibers, liquid crystal copolyester fibers, polypropylene fibers, particularly highly oriented extended chain polypropylene fibers, polyvinyl alcohol fibers, polyacrylonitrile fibers and rigid rod fibers, particularly M5® fibers. Specifically most preferred fibers for use in the fabrication of the ballistic resistant substrate are aramid fibers, polyethylene fibers, polypropylene fibers and glass fibers.

In the case of polyethylene, preferred fibers are extended chain polyethylenes having molecular weights of at least 300,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,413,110; 4,536,536; 4,551,296; 4,663,101; 5,006,390; 5,032,338; 5,578,374; 5,736,244; 5,741,451; 5,958,582; 5,972,498; 6,448,359; 6,746,975; 6,969,553; 7,078,099; 7,344,668 and U.S. patent application publication 2007/0231572, all of which are incorporated herein by reference. Particularly preferred fiber types for use in the ballistic resistant substrate of the invention are any of the polyethylene fibers sold under the trademark SPECTRA® from Honeywell International Inc. SPECTRA® fibers are well known in the art. Other useful polyethylene fiber types also include and DYNEEMA® UHMWPE yarns commercially available from Royal DSM N.V. Corporation of Heerlen, The Netherlands.

Preferred are aramid (aromatic polyamide) or para-aramid fibers are commercially available and are described, for example, in U.S. Pat. No. 3,671,542. For example, useful poly(p-phenylene terephthalamide) filaments are produced commercially by DuPont under the trademark of KEVLAR®. Also useful in the practice of this invention are poly (m-phenylene isophthalamide) fibers produced commercially by DuPont of Wilmington, Del. under the trademark NOMEX® and fibers produced commercially by Teijin Aramid Gmbh of Germany under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable PBO fibers for the practice of this invention are commercially available and are disclosed for example in U.S. Pat. Nos. 5,286,833, 5,296,185, 5,356,584, 5,534,205 and 6,040,050, each of which is incorporated herein by reference. Suitable liquid crystal copolyester fibers for the practice of this invention are commercially available and are disclosed, for example, in U.S. Pat. Nos. 3,975,487; 4,118,372 and 4,161,470, each of which is incorporated herein by reference, and including VECTRAN® liquid crystal copolyester fibers commercially available from Kuraray Co., Ltd. of Tokyo, Japan. Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

M5® fibers are formed from pyridobisimidazole-2,6-diyl (2,5-dihydroxy-p-phenylene) and were most recently manufactured by Magellan Systems International of Richmond, Va. and are described, for example, in U.S. Pat. Nos. 5,674,969, 5,939,553, 5,945,537, and 6,040,478, each of which is incorporated herein by reference.

Fiberglass ballistic resistant substrates preferably comprise composites of glass fibers, preferably S-glass fibers, which are impregnated with a thermosetting or thermoplastic polymeric resin, such as a thermosetting epoxy or phenolic resin. Such materials are well known in the art and are commercially available. Preferred examples non-exclusively include substrates comprising S2-Glass® commercially available from AGY of Aiken, S.C.; ballistic resistant liners formed from HiPerTex™ E-Glass fibers, commercially available from 3B Fibreglass of Battice, Belgium. Also suitable are glass fiber materials comprising R-glass fibers, such as those commercially available under the trademark VETROTEX® from Saint-Gobain of Courbevoie, France. Also suitable are combinations of all the above materials, all of which are commercially available.

As used herein, the term "tape" refers to a flat, narrow, monolithic strip of material having a length greater than its width and an average cross-sectional aspect ratio, i.e. the ratio of the greatest to the smallest dimension of cross-sections averaged over the length of the tape article, of at least about 3:1. A tape may be a fibrous material or a non-fibrous material. A "fibrous material" comprises one or more filaments.

In embodiments where the ballistic resistant substrate comprises fibrous tapes, a tape may comprise a strip of woven fabric, or may comprise a plurality of fibers or yarns arranged in a generally unidirectional array of generally parallel fibers. Methods for fabricating fibrous tapes are described, for example, in U.S. Pat. No. 8,236,119 and U.S. patent application Ser. Nos. 13/021,262; 13/494,641; 13/568,097; 13/647,926 and 13/708,360, the disclosures of which are incorporated herein by reference. Other methods for fabricating fibrous tapes are described, for example, in U.S. Pat. Nos. 2,035,138; 4,124,420; 5,115,839, or by use of a ribbon loom specialized for weaving narrow woven fabrics or ribbons. Useful ribbon looms are disclosed, for example, in U.S. Pat. Nos. 4,541,461; 5,564,477; 7,451,787 and 7,857,012, each of which is assigned to Textilma AG of Stansstad, Switzerland, and each of which is incorporated herein by reference to the extent consistent herewith, although any alternative ribbon loom is equally useful. Polymeric tapes may also be formed by other conventionally known methods, such as extrusion, pultrusion, slit film techniques, etc. For example, a unitape of standard thickness may be cut or slit into tapes having the desired lengths. An example of a slitting apparatus is disclosed in U.S. Pat. No. 6,098,510 which teaches an apparatus for slitting a sheet material web as it is wound onto said roll. Another example of a slitting apparatus is disclosed in U.S. Pat. No. 6,148,871, which teaches an apparatus for slitting a sheet of a polymeric film into a plurality of film strips with a plurality of blades. The disclosures of both U.S. Pat. No. 6,098,510 and U.S. Pat. No. 6,148,871 are incorporated herein by reference to the extent consistent herewith. Methods for fabricating non-woven, non-fibrous polymeric tapes are described, for example, in U.S. Pat. Nos. 7,300,691; 7,964,266 and 7,964,267, which are incorporated herein by reference. For each of these tape embodiments, multiple layers of tape-based materials may be stacked and consolidated/molded in a similar fashion as the fibrous materials, with or without a polymeric binder material.

In embodiments where the ballistic resistant substrate is a non-fibrous tape-based material, particularly suitable high-strength, high tensile modulus polymeric tape materials are polyolefin tapes. Preferred polyolefin tapes include polyethylene tapes, such as those commercially available under the trademark TENSYLON®, which is commercially available from E. I. du Pont de Nemours and Company of Wilmington, Del. See, for example, U.S. Pat. Nos. 7,964,266 and 7,964,267 which are incorporated herein by reference. Also suitable are polypropylene tapes, such as those commercially available under the trademark TEGRIS® from Milliken & Company of Spartanburg, S.C. See, for example, U.S. Pat. No. 7,300,691 which is incorporated herein by reference. Polyolefin tape-based composites that are useful as ballistic resistant substrates herein are also commercially available, for example under the trademark DYNEEMA® BT10 from Royal DSM N.V. Corporation of Heerlen, The Netherlands and under the trademark ENDUMAX® from Teijin Aramid Gmbh of Germany.

Such tapes preferably have a substantially rectangular cross-section with a thickness of about 0.5 mm or less, more preferably about 0.25 mm or less, still more preferably about 0.1 mm or less and still more preferably about 0.05 mm or less. In the most preferred embodiments, the polymeric tapes have a thickness of up to about 3 mils (76.2 μm), more preferably from about 0.35 mil (8.89 μm) to about 3 mils (76.2 μm), and most preferably from about 0.35 mil to about 1.5 mils (38.1 μm). Thickness is measured at the thickest region of the cross-section.

Polymeric tapes useful in the invention have preferred widths of from about 2.5 mm to about 50 mm, more preferably from about 5 mm to about 25.4 mm, even more preferably from about 5 mm to about 20 mm, and most preferably from about 5 mm to about 10 mm. These dimensions may vary but the polymeric tapes formed herein are most preferably fabricated to have dimensions that achieve an average cross-sectional aspect ratio, i.e. the ratio of the greatest to the smallest dimension of cross-sections averaged over the length of the tape article, of greater than about 3:1, more preferably at least about 5:1, still more preferably at least about 10:1, still more preferably at least about 20:1, still more preferably at least about 50:1, still more preferably at least about 100:1, still more preferably at least about 250:1 and most preferred polymeric tapes have an average cross-sectional aspect ratio of at least about 400:1.

The fibers and tapes may be of any suitable denier. For example, fibers may have a denier of from about 50 to about 3000 denier, more preferably from about 200 to 3000 denier, still more preferably from about 650 to about 2000 denier, and most preferably from about 800 to about 1500 denier. Tapes may have deniers from about 50 to about 30,000, more preferably from about 200 to 10,000 denier, still more preferably from about 650 to about 2000 denier, and most preferably from about 800 to about 1500 denier. The selection is governed by considerations of ballistic effectiveness and cost. Finer fibers/tapes are more costly to manufacture and to weave, but can produce greater ballistic effectiveness per unit weight.

As stated above, a high-strength, high tensile modulus fiber/tape is one which has a preferred tenacity of about 7 g/denier or more, a preferred tensile modulus of about 150 g/denier or more and a preferred energy-to-break of about 8 J/g or more, each as measured by ASTM D2256. Preferred fibers have a preferred tenacity of about 15 g/denier or more, more preferably about 20 g/denier or more, still more preferably about 25 g/denier or more, still more preferably about 30 g/denier or more, still more preferably about 40 g/denier or more, still more preferably about 45 g/denier or more, and most preferably about 50 g/denier or more. Preferred tapes have a preferred tenacity of about 10 g/denier or more, more preferably about 15 g/denier or more, still more preferably about 17.5 g/denier or more, and most preferably about 20 g/denier or more. Wider tapes will have lower tenacities. Preferred fibers/tapes also have a preferred tensile modulus of about 300 g/denier or more, more preferably about 400 g/denier or more, more preferably about 500 g/denier or more, more preferably about 1,000 g/denier or more and most preferably about 1,500 g/denier or more. Preferred fibers/tapes also have a preferred energy-to-break of about 15 J/g or more, more preferably about 25 J/g or more, more preferably about 30 J/g or more and most preferably have an energy-to-break of about 40 J/g or more. Methods of forming each of the preferred fiber and tape types having these combined high strength properties are conventionally known in the art.

The fibers and tapes forming the ballistic resistant substrate are preferably, but not necessarily, at least partially coated with a polymeric binder material. A binder is optional because some materials, such as high modulus polyethylene tapes, do not require a polymeric binder to bind together a plurality of said tapes into a molded layer or molded article. Useful ballistic resistant substrates may also be formed from, for example, soft woven tapes or fibrous products that require neither a polymeric/resinous binder material nor molding.

As used herein, a "polymeric" binder or matrix material includes resins and rubber. When present, the polymeric binder material either partially or substantially coats the individual fibers/tapes of the ballistic resistant substrate, preferably substantially coating each of the individual fibers/tapes. The polymeric binder material is also commonly known in the art as a "polymeric matrix" material. These terms are conventionally known in the art and describe a material that binds fibers or tapes together either by way of its inherent adhesive characteristics or after being subjected to well known heat and/or pressure conditions.

Suitable polymeric binder materials include both low modulus, elastomeric materials and high modulus, rigid materials. As used herein throughout, the term tensile modulus means the modulus of elasticity, which for fibers is measured by ASTM D2256 and by ASTM D638 for a polymeric binder material. The tensile properties of polymeric tapes may be measured by ASTM D882 or another suitable method as determined by one skilled in the art. The rigidity, impact and ballistic properties of the articles formed from the composites of the invention are affected by the tensile modulus of the polymeric binder polymer coating the fibers/tapes. A low or high modulus binder may comprise a variety of polymeric and non-polymeric materials. A preferred polymeric binder comprises a low modulus elastomeric material. For the purposes of this invention, a low modulus elastomeric material has a tensile modulus measured at about 6,000 psi (41.4 MPa) or less according to ASTM D638 testing procedures. A low modulus polymer is preferably an elastomer having a tensile modulus of about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably less than about 0° C., more preferably the less than about −40° C., and most preferably less than about −50° C. The elastomer also has a preferred elongation to break of at least about 50%, more preferably at least about 100% and most preferably has an elongation to break of at least about 300%.

A wide variety of materials and formulations having a low modulus may be utilized as the polymeric binder. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, polyamides (useful with some fiber/tape types), acrylonitrile butadiene styrene, polycarbonates, and combinations thereof, as well as other low modulus polymers and copolymers curable below the melting point of the fiber. Also useful are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type R-$(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. Also useful are resin dispersions of styrene-isoprene-styrene (SIS) block copolymer sold under the trademark PRINLIN® and commercially available from Henkel Technologies, based in Düsseldorf, Germany. Conventional low modulus polymeric binder polymers include polystyrene-polyisoprene-polystyrene-block copolymers sold under the trademark KRATON® commercially produced by Kraton Polymers.

While low modulus polymeric binder materials are preferred for the formation of flexible armor materials, high modulus polymeric binder materials are preferred for the formation of rigid armor articles. High modulus, rigid materials generally have a higher initial tensile modulus than 6,000 psi. Useful high modulus, rigid polymeric binder materials include polyurethanes (both ether and ester based), epoxies, polyacrylates, phenolic/polyvinyl butyral (PVB) polymers, vinyl ester polymers, styrene-butadiene block copolymers, as well as mixtures of polymers such as vinyl ester and diallyl phthalate or phenol formaldehyde and polyvinyl butyral. A particularly useful rigid polymeric binder material is a thermosetting polymer that is soluble in carbon-carbon saturated solvents such as methyl ethyl ketone, and possessing a high tensile modulus when cured of at least about $1\times10^6$ psi (6895 MPa) as measured by ASTM D638. Particularly useful rigid polymeric binder materials are those described in U.S. Pat. No. 6,642,159, the disclosure of which is incorporated herein by reference. The polymeric binder, whether a low modulus material or a high modulus material, may also include fillers such as carbon black or silica, may be extended with oils, or may be vulcanized by sulfur, peroxide, metal oxide or radiation cure systems as is well known in the art.

Also preferred are polar resins or polar polymers, particularly polyurethanes within the range of both soft and rigid materials at a tensile modulus ranging from about 2,000 psi (13.79 MPa) to about 8,000 psi (55.16 MPa). Preferred polyurethanes are applied as aqueous polyurethane dispersions that are most preferably co-solvent free. Such includes aqueous anionic polyurethane dispersions, aqueous cationic polyurethane dispersions and aqueous nonionic polyurethane dispersions. Particularly preferred are aqueous anionic polyurethane dispersions, and most preferred are aqueous anionic, aliphatic polyurethane dispersions. Such includes aqueous anionic polyester-based polyurethane dispersions; aqueous aliphatic polyester-based polyurethane dispersions; and aqueous anionic, aliphatic polyester-based polyurethane dispersions, all of which are preferably cosolvent free dispersions. Such also includes aqueous anionic polyether polyurethane dispersions; aqueous aliphatic polyether-based polyurethane dispersions; and aqueous anionic, aliphatic polyether-based polyurethane dispersions, all of which are preferably cosolvent free dispersions. Similarly preferred are all corresponding variations (polyester-based; aliphatic polyester-based; polyether-based; aliphatic polyether-based, etc.) of aqueous cationic and aqueous nonionic dispersions. Most preferred is an aliphatic polyurethane dispersion having a modulus at 100% elongation of about 700 psi or more, with a particularly preferred range of 700 psi to about 3000 psi. More preferred are aliphatic polyurethane dispersions having a modulus at 100% elongation of about 1000 psi or more, and still more preferably about 1100 psi or more. Most preferred is an aliphatic, polyether-based anionic polyurethane dispersion having a modulus of 1000 psi or more, preferably 1100 psi or more. The most preferred binders are those that will convert the most projectile kinetic energy into a shock wave, which shock wave is then mitigated by the vacuum panel.

Methods for applying a polymeric binder material to fibers and tapes to thereby impregnate fiber/tape layers with the binder are well known and readily determined by one skilled in the art. The term "impregnated" is considered herein as being synonymous with "embedded," "coated," or otherwise applied with a polymeric coating where the binder material diffuses into the layer and is not simply on a surface of the layer. Any appropriate application method may be utilized to apply the polymeric binder material and particular use of a term such as "coated" is not intended to limit the method by which it is applied onto the filaments/fibers. Useful methods include, for example, spraying, extruding or roll coating polymers or polymer solutions onto the fibers/tapes, as well as transporting the fibers/tapes through a molten polymer or polymer solution. Most preferred are methods that substantially coat or encapsulate each of the individual fibers/tapes and cover all or substantially all of the fiber/tape surface area with the polymeric binder material.

Fibers and tapes that are woven into woven fibrous layers or woven tape layers are preferably at least partially coated with a polymeric binder, followed by a consolidation step similar to that conducted with non-woven layers. Such a consolidation step may be conducted to merge multiple woven fiber or tape layers with each other, or to further merge a binder with the fibers/tapes of said woven layers. For example, a plurality of woven fiber layers do not necessarily have to be consolidated, and may be attached by other means, such as with a conventional adhesive, or by stitching, whereas a polymeric binder coating is generally necessary to efficiently consolidate a plurality of non-woven fiber plies.

Woven fabrics may be formed using techniques that are well known in the art using any fabric weave, such as plain weave, crowfoot weave, basket weave, satin weave, twill weave and the like. Plain weave is most common, where fibers are woven together in an orthogonal 0°/90° orientation. Typically, weaving of fabrics is performed prior to coating the fibers with a polymeric binder, where the woven fabrics are thereby impregnated with the binder. However, the invention is not intended to be limited by the stage at which the polymeric binder is applied. Also useful are 3D weaving methods wherein multi-layer woven structures are fabricated by weaving warp and weft threads both horizontally and vertically. Coating or impregnation with a polymeric binder material is also optional with such 3D woven fabrics, but a binder is specifically not mandatory for the fabrication of a multilayer 3D woven ballistic resistant substrate.

Methods for the production of non-woven fabrics (non-woven plies/layers) from fibers and tapes are well known in the art. For example, in a preferred method for forming non-woven fabrics, a plurality of fibers/tapes are arranged into at least one array, typically being arranged as a fiber/tape web comprising a plurality of fibers/tapes aligned in a substantially parallel, unidirectional array. In a typical process, tapes or fiber bundles are supplied from a creel and led through guides and optionally one or more spreader bars into a collimating comb, which is typically followed by coating the fibers/tapes with a polymeric binder material. A typical fiber bundle will have from about 30 to about 2000 individual fibers. When starting with bundles of filaments, the spreader bars and collimating comb disperse and spread out the bundled fibers, reorganizing them side-by-side in a coplanar fashion. Ideal fiber spreading results in the individual filaments or individual fibers being positioned next to one another in a single fiber plane, forming a substantially unidirectional, parallel array of fibers without fibers overlapping each other.

After the fibers/tapes are coated with an optional binder material the coated fibers/tapes are formed into non-woven fiber layers that comprise a plurality of overlapping, non-woven plies that are consolidated into a single-layer, monolithic element. In a preferred non-woven fabric structure for the ballistic resistant substrate, a plurality of stacked, overlapping unitapes are formed wherein the parallel fibers/tapes of each single ply (unitape) are positioned orthogonally to the parallel fibers/tapes of each adjacent single ply relative to the longitudinal fiber direction of each single ply. The stack of overlapping non-woven fiber/tape plies is consolidated under heat and pressure, or by adhering the coatings of individual fiber/tape plies, to form a single-layer, monolithic element which has also been referred to in the art as a single-layer, consolidated network where a "consolidated network" describes a consolidated (merged) combination of fiber/tape plies with the optional polymeric matrix/binder. The ballistic resistant substrate may also comprise a consolidated hybrid combination of woven fabrics and non-woven fabrics, as well as combinations of non-woven fabrics formed from unidirectional fiber plies and non-woven felt fabrics.

Most typically, non-woven fiber/tape layers or fabrics include from 1 to about 6 plies, but may include as many as about 10 to about 20 plies as may be desired for various applications. The greater the number of plies translates into greater ballistic resistance, but also greater weight. As is conventionally known in the art, excellent ballistic resistance is achieved when individual fiber/tape plies are cross-plied such that the fiber alignment direction of one ply is rotated at an angle with respect to the fiber alignment direction of another ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,574; and 4,737,402, all of which are incorporated herein by reference to the extent not incompatible herewith.

Methods of consolidating fiber plies/layers to form complex composites are well known, such as by the methods described in U.S. Pat. No. 6,642,159. Consolidation can occur via drying, cooling, heating, pressure or a combination thereof. Heat and/or pressure may not be necessary, as the fibers or fabric layers may just be glued together, as is the case in a wet lamination process. Typically, consolidation is done by positioning the individual fiber/tape plies on one another under conditions of sufficient heat and pressure to cause the plies to combine into a unitary fabric. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that a polymeric binder coating can be caused to stick or flow without completely melting. However, generally, if the polymeric binder material is caused to melt, relatively little pressure is required to form the composite, while if the binder material is only heated to a sticking point, more pressure is typically required. As is conventionally known in the art, consolidation may be conducted in a calender set, a flat-bed laminator, a press or in an autoclave. Consolidation may also be conducted by vacuum molding the material in a mold that is placed under a vacuum. Vacuum molding technology is well known in the art. Most commonly, a plurality of orthogonal fiber/tape webs are "glued" together with the binder polymer and run through a flat bed laminator to improve the uniformity and strength of the bond. Further, the consolidation and polymer application/ bonding steps may comprise two separate steps or a single consolidation/lamination step.

Alternately, consolidation may be achieved by molding under heat and pressure in a suitable molding apparatus. Generally, molding is conducted at a pressure of from about 50 psi (344.7 kPa) to about 5,000 psi (34,470 kPa), more preferably about 100 psi (689.5 kPa) to about 3,000 psi (20,680 kPa), most preferably from about 150 psi (1,034 kPa) to about 1,500 psi (10,340 kPa). Molding may alternately be conducted at higher pressures of from about 5,000 psi (34,470 kPa) to about 15,000 psi (103,410 kPa), more preferably from about 750 psi (5,171 kPa) to about 5,000 psi, and more preferably from about 1,000 psi to about 5,000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. and most preferably at a temperature from about 200° F. to about 280° F. The pressure under which the fiber/tape layers are molded has a direct effect on the stiffness or flexibility of the resulting molded product. Particularly, the higher the pressure at which they are molded, the higher the stiffness, and vice-versa. In addition to the molding pressure, the quantity, thickness and composition of the fiber/tape plies and polymeric binder coating type also directly affects the stiffness of the ballistic resistant substrate formed therefrom.

While each of the molding and consolidation techniques described herein are similar, each process is different. Particularly, molding is a batch process and consolidation is a generally continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In either process, suitable temperatures, pressures and times are generally dependent on the type of polymeric binder coating materials, polymeric binder content, process used and fiber/tape type.

When the ballistic resistant substrate does include a binder/matrix, the total weight of the binder/matrix comprising the ballistic resistant substrate preferably comprises from about 2% to about 50% by weight, more preferably from about 5% to about 30%, more preferably from about 7% to about 20%, and most preferably from about 11% to about 16% by weight of the fibers/tapes plus the weight of the coating. A lower binder/matrix content is appropriate for woven fabrics, wherein a polymeric binder content of greater than zero but less than 10% by weight of the fibers/tapes plus the weight of the coating is typically most preferred, but this is not intended as limiting. For example, phenolic/PVB impregnated woven aramid fabrics are sometimes fabricated with a higher resin content of from about 20% to about 30%, although around 12% content is typically preferred.

The ballistic resistant substrate may also optionally comprise one or more thermoplastic polymer layers attached to one or both of its outer surfaces. Suitable polymers for the thermoplastic polymer layer non-exclusively include polyolefins, polyamides, polyesters (particularly polyethylene terephthalate (PET) and PET copolymers), polyurethanes, vinyl polymers, ethylene vinyl alcohol copolymers, ethylene octane copolymers, acrylonitrile copolymers, acrylic polymers, vinyl polymers, polycarbonates, polystyrenes, fluoropolymers and the like, as well as co-polymers and mixtures thereof, including ethylene vinyl acetate (EVA) and ethylene acrylic acid. Also useful are natural and synthetic rubber polymers. Of these, polyolefin and polyamide layers are preferred. The preferred polyolefin is a polyethylene. Non-limiting examples of useful polyethylenes are low density polyethylene (LDPE), linear low density polyethylene (LLDPE), medium density polyethylene (MDPE), linear medium density polyethylene (LMDPE), linear very-low density polyethylene (VLDPE), linear ultra-low density polyethylene (ULDPE), high density polyethylene (HDPE) and co-polymers and mixtures thereof. Also useful are SPUNFAB® polyamide webs commercially available from Spunfab, Ltd, of Cuyahoga Falls, Ohio (trademark registered to Keuchel Associates, Inc.), as well as THERMOPLAST™ and HELIOPLAST™ webs, nets and films, commercially available from Protechnic S.A. of Cernay, France. Such a thermoplastic polymer layer may be bonded to the ballistic resistant substrate surfaces using well known techniques, such as thermal lamination. Typically, laminating is done by positioning the individual layers on one another under conditions of sufficient heat and pressure to cause the layers to combine into a unitary structure. Lamination may be conducted at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. Such thermoplastic polymer layers may alternatively be bonded to the ballistic resistant substrate surfaces with hot glue or hot melt fibers as would be understood by one skilled in the art.

In embodiments where the ballistic resistant substrate does not include a polymeric binder material coating the fibers or tapes forming the substrate, it is preferred that a one or more thermoplastic polymer layers as described above be employed to bond fiber/tape plies together or improve the bond between adjacent fiber/tape plies. In one embodiment, a ballistic resistant substrate comprises a plurality of unidirectional fiber plies or tape plies wherein a thermoplastic polymer layers is positioned between each adjacent fiber ply or tape ply. For example, in one preferred embodiment the ballistic resistant substrate has the following structure: thermoplastic polymer film/binder-less 0° UDT/thermoplastic polymer film/90° binder-less UDT thermoplastic polymer film. In this exemplary embodiment, the ballistic resistant substrate may include additional binder-less UDT plies where a thermoplastic polymer film is present between each pair of adjacent UDT plies. In addition, in this exemplary embodiment, a unitape (UDT) may comprise a plurality of parallel fibers or a plurality of parallel tapes. This exemplary embodiment is not intended to be strictly limiting. For example, the UDT elongate bodies (i.e. fiber or tapes) of the UDT plies may be oriented at other angles, such as thermoplastic polymer film/0° binder-less UDT/thermoplastic polymer film/45° binder-less UDT/thermoplastic polymer film/90° binder-less UDT thermoplastic polymer film/45° binder-less UDT/thermoplastic polymer film/0° binder-less UDT/thermoplastic polymer film, etc., or the plies may be oriented at other angles. The outermost thermoplastic polymer films may also be optionally excluded as determined by one skilled in the art. Such binder-less structures may be made by stacking the component layers on top of each other in coextensive fashion and consolidating/molding them together according to the consolidation/molding conditions described herein.

The thickness of the ballistic resistant substrate will correspond to the thickness of the individual fibers/tapes and the number of fiber/tape plies or layers incorporated into the substrate. For example, a preferred woven fabric will have a preferred thickness of from about 25 μm to about 600 μm per ply/layer, more preferably from about 50 μm to about 385 μm and most preferably from about 75 μm to about 255 μm per ply/layer. A preferred two-ply non-woven fabric will have a preferred thickness of from about 12 μm to about 600 μm, more preferably from about 50 μm to about 385 μm and most preferably from about 75 μm to about 255 μm. Any thermoplastic polymer layers are preferably very thin, having preferred layer thicknesses of from about 1 μm to about 250 μm, more preferably from about 5 μm to about 25 μm and most preferably from about 5 μm to about 9 μm. Discontinuous webs such as SPUNFAB® non-woven webs are preferably applied with a basis weight of 6 grams per square meter (gsm). While such thicknesses are preferred, it is to be understood that other thicknesses may be produced to satisfy a particular need and yet fall within the scope of the present invention.

The ballistic resistant substrate comprises multiple fiber/tape plies or layers, which layers are stacked one upon another and optionally, but preferably, consolidated. The ballistic resistant substrate will have a preferred composite areal density of from about 0.2 psf to about 8.0 psf, more preferably from about 0.3 psf to about 6.0 psf, still more preferably from about 0.5 psf to about 5.0 psf, still more preferably from about 0.5 psf to about 3.5 psf, still more preferably from about 1.0 psf to about 3.0 psf, and most preferably from about 1.5 psf to about 2.5 psf.

In embodiments where the ballistic resistant substrate is a rigid, non-fiber based, non-tape based material, the substrate comprises neither fibers nor tapes, but comprises a rigid material such as a ceramic material, glass, metal, a metal-filled composite, a ceramic-filled composite, a glass-filled composite, a cermet material, or a combination thereof. Of these, preferred materials are steel, particularly high hardness steel (HHS), as well as aluminum alloys, titanium or combinations thereof. Preferably, such a rigid material comprises a rigid plate that is attached to one or more vacuum panels in a face-to-face relationship, just as the substrates formed from both fiber-based and tape-based substrates. If a ballistic resistant article of the invention incorporates multiple substrates, it is preferred that only one rigid substrate is used with the rest of the substrates being fiber-based and/or tape-based substrates, preferably with the rigid substrate positioned as the strike face of the article.

Three most preferred types of ceramics include aluminum oxide, silicon carbide and boron carbide. In this regard, a rigid substrate may incorporate a single monolithic ceramic plate, or may comprise small tiles or ceramic balls suspended in flexible resin, such as a polyurethane. Suitable resins are well known in the art. Additionally, multiple layers or rows of tiles may be attached to a vacuum panel surface. For example, 3 in.×3 in.×0.1 in. (7.62 cm×7.62 cm×0.254 cm) ceramic tiles may be mounted on a 12 in.×12 in. (30.48 cm×30.48 cm) panel using a thin polyurethane adhesive film, preferably with all ceramic tiles being lined up with such that no gap is present between tiles. A second row of tiles may then be attached to the first row of ceramic, with an offset so that joints are scattered. This would continue all the way down and across to cover the entire vacuum panel surface. Additionally, a substrate formed from a rigid non-fiber-based, non-tape-based material such as HHS may be attached to a fiber-based substrate, which fiber-based substrate is then attached to the face of a vacuum panel. For example, in one preferred configuration, a ballistic resistant article of the invention comprises a ceramic plate/a molded fibrous backing material/a vacuum panel/an optional air space/a soft or hard fibrous armor material. Other configurations may also be useful.

As previously stated, the ballistic resistant substrate and the vacuum panel may be coupled with each other with or without the surfaces directly touching each other. In preferred embodiments, at least one ballistic resistant substrate is directly attached to at least one vacuum panel with an adhesive. Any suitable adhesive material may be used. Suitable adhesives non-exclusively include elastomeric materials such as polyethylene, cross-linked polyethylene, chlorosulfonated polyethylene, ethylene copolymers, polypropylene, propylene copolymers, polybutadiene, polyisoprene, natural rubber, ethylene-propylene copolymers, ethylene-propylene-diene terpolymers, polysulfide polymers, polyurethane elastomers, polychloroprene, plasticized polyvinylchloride using one or more plasticizers that are well known in the art (such as dioctyl phthalate), butadiene acrylonitrile elastomers, poly (isobutylene-co-isoprene), polyacrylates, polyesters, unsaturated polyesters, polyethers, fluoroelastomers, silicone elastomers, copolymers of ethylene, thermoplastic elastomers, phenolics, polybutyrals, epoxy polymers, styrenic block copolymers, such as styrene-isoprene-styrene or styrene-butadiene-styrene types, and other suitable adhesive compositions conventionally known in the art. Particularly preferred adhesives include methacrylate adhesives, cyanoacrylate adhesives, UV cure adhesives, urethane adhesives, epoxy adhesives and blends of the above materials. Of these, an adhesive comprising a polyurethane thermoplastic adhesive, particularly a blend of one or more polyurethane thermoplastics with one or more other thermoplastic polymers, is preferred. Most preferably, the adhesive comprises polyether aliphatic polyurethane. Such adhesives may be applied, for example, in the form of a hot melt, film, paste or spray, or as a two-component liquid adhesive.

Other suitable means for direct attachment of the elements non-exclusively includes sewing or stitching them together, as well as bolting them or screwing them together such that their surfaces contact each other. Bolts and screws may also be used to indirectly couple the substrate and the vacuum panel. To stitch, sew, bolt or screw the vacuum panel to the ballistic resistant substrate, it would be necessary for the vacuum panel to have a peripheral border or other element facilitating attachment without puncturing the panel and destroying the vacuum. Alternatively, the ballistic resistant substrate and vacuum panel may be indirectly coupled to each other whereby they are joined together by a connector instrument wherein together they form integral elements of a single, unitary article but their surfaces do not touch each other. In this embodiment, the ballistic resistant substrate and the vacuum panel may be positioned spaced apart from each other by at least about 2 mm. Various instruments may be used to connect the ballistic resistant substrate and the vacuum panel. Non-limiting examples of connector instruments include connecting anchors, such as rivets, bolts, nails, screws and brads, where the substrate and panel surfaces are kept apart from each other such that there is a space between the ballistic resistant panel and vacuum panel. Also suitable are strips of hook-and-loop fasteners such as VELCRO® brand products commercially available from Velcro Industries B.V. of Curacao, The Netherlands, or 3M™ brand hook and loop fasteners, double sided tape, and the like.

Also useful are flat spacing strips; spacing frames and extruded channels as described in commonly-owned U.S. Pat. No. 7,930,966, which is incorporated herein by reference to the extent consistent herewith. Suitable spacing frames include slotted frames, where the panels of the invention would be positioned into slots (or grooves) of the frame which hold them in place; and non-slotted frames that are positioned between and attached to adjacent panels, thereby separating and connecting said panels. Frames may be formed from any suitable material as would be determined by one skilled in the art, including wood frames, metal frames and fiber reinforced polymer composite frames. Extruded channels may be formed of any extrudable material, including metals and polymers.

Also suitable are frames or sheets such as wood sheets, fiberboard sheets, particleboard sheets, sheets of ceramic material, metal sheets, plastic sheets, or even a layer of foam positioned between and in contact with both a surface of the ballistic resistant substrate and vacuum panel. Such are described in more detail in commonly-owned U.S. Pat. No. 7,762,175 which is incorporated herein by reference to the extent consistent herewith.

Figure 7:
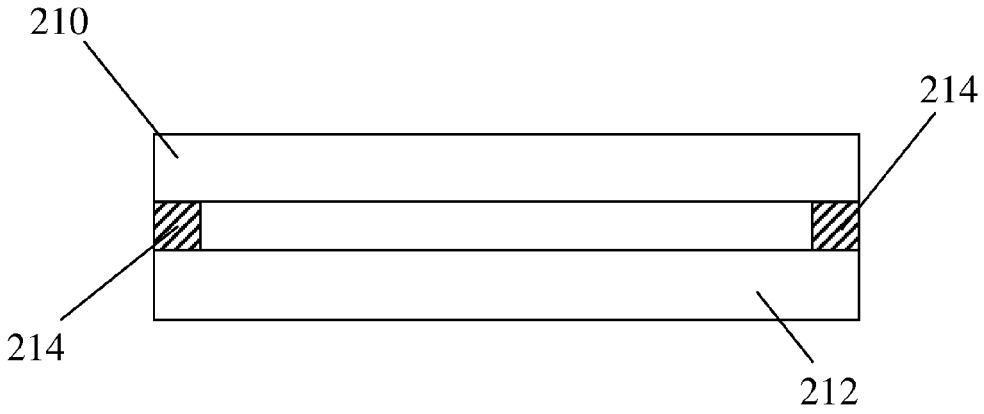
FIG. 7 is an edge view schematic representation of ballistic resistant article of the invention wherein a ballistic resistant substrate and a vacuum panel are indirectly coupled by and spaced apart by connecting anchors.
Figure 8:
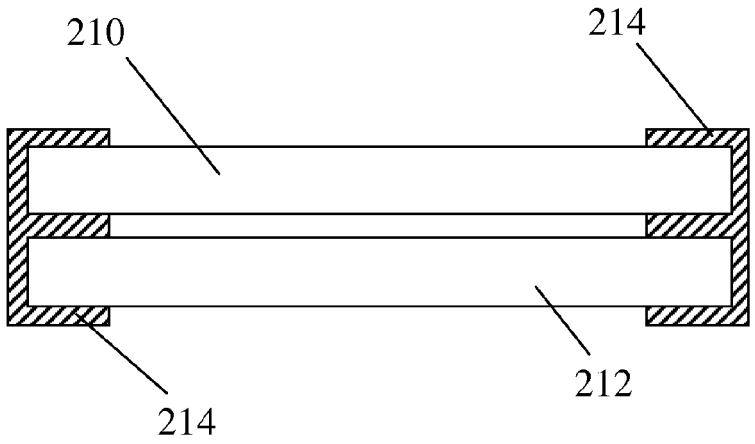
FIG. 8 is an edge view schematic representation of ballistic resistant article of the invention wherein a ballistic resistant substrate and a vacuum panel are indirectly coupled by and spaced apart by connecting anchors by a frame.

FIG. 7 illustrates an embodiment where a ballistic resistant substrate 210 is indirectly coupled with a vacuum panel 212 by connecting anchors 214 at the corners of the substrate 210 and panel 212. FIG. 8 illustrates an embodiment where substrate 210 and panel 212 are separated by a slotted frame. Such connector instruments are specifically exclusive of adhesives and synthetic fabrics, such as other ballistic resistant fabrics, other non-ballistic resistant fabrics, or fiberglass.

The ballistic resistant articles of the invention are particularly suitable for any body armor application that requires low backface deformation, i.e. optimal blunt trauma resistance, including flexible, soft armor articles as well as rigid, hard armor articles, as well as for the defense of vehicles and structural elements, such as building walls. When employed, the ballistic resistant articles of the invention should be oriented so that the ballistic resistant substrate is positioned as the strike face of the article and said vacuum panel is positioned behind the ballistic resistant substrate to receive any shock wave that initiates from an impact of a projectile with the ballistic resistant substrate. The generation of a shock wave is a significant component of the energy transferred to armor upon a projectile impact, with low deflection materials converting more of the kinetic energy from a projectile into a shock wave than high deflection materials. The vacuum panel functions to mitigate or entirely eliminate this shock wave energy, ensuring that energy of a projectile impact is dissipated in a manner that reduces the composite backface deformation while retaining superior ballistic penetration resistance.

In this regard, the ballistic resistant articles of the invention incorporating an appropriate vacuum panel backing achieve significantly improved backface signature performance relative to armor articles having no backing structure or using a conventional backing material such as closed-cell foam, open-cell foam or a flexible honeycomb. Improved backface signature performance may also be achieved at lower weights when substituting vacuum panels for additional ballistic material that are often used in place of an armor backing material.

The following examples serve to illustrate the invention.

Comparative Examples 1-9 and 13-19

Inventive Examples 10-12

Ballistic testing was conducted to determine the affect of a vacuum panel backing material on shock wave mitigation and resulting depth of backface deformation.

All testing conditions were kept constant in each example except for the type of backing material. The backing material used for each sample is identified in Table 1. The McMaster-Carr B43NES-SE backing used in Comparative Examples 1-3 was a 0.25 inch thick Neoprene/EPDM/SBr (Neoprene/ethylene propylene diene monomer/styrene-butadiene rubber) closed cell foam commercially available from McMaster-Carr of Robbinsville, N.J. The "(2X) United Foam XRD 15 PCF" backing used in Comparative Examples 4-6 consisted of two layers of 0.125 inch thick Qycell irradiated cross-linked polyethylene closed cell foam commercially available from UFP Technologies of Raritan, N.J. and manufactured by Qycell Corporation of Ontario, CA. The "Adhesive Backed Open Cell Foam" used in Comparative Examples 7-9 was a 0.25 inch thick water-resistant, super-cushioning open cell polyurethane foam with an adhesive backing, commercially available from McMaster-Carr. The "NanoPore Insulation" used in Inventive Examples 10-12 was a 0.25 inch thick vacuum panel commercially available from NanoPore Insulation LLC of Albuquerque, N. Mex. The interior of the vacuum panel included a porous carbon fiber mat as an interior supporting structure which prevents the envelope from collapsing when the vacuum is drawn.

The "Supracor Honeycomb, A2 0.25 CELL/E0000139" backing used in Comparative Example 13 was a 0.19 inch thick, flexible, closed cell honeycomb material commercially available from Supracor, Inc. of San Jose, Calif. The "non-woven PE fabric armor" backing used in Comparative Examples 14-15 was a 0.25 inch thick proprietary non-woven fabric composite commercially available from Honeywell International Inc. It consisted of 38 two-ply unidirectional) (0°/90° layers comprising UHMW PE fibers and a polyurethane binder resin, and having an areal density of 1.00 psf. The "Supracor Honeycomb, ST8508, 0.187 Cell, ST05X2/E0000139" backing used in Comparative Example 16 was a 0.19 inch thick, flexible, open cell honeycomb material commercially available from Supracor, Inc. The "Supracor Honeycomb, SU8508, 0.25 Cell, SU05X2/E0000139" backing used in Comparative Example 17 was a 0.19 inch thick, flexible, open cell honeycomb material commercially available from Supracor, Inc.

Each backing material was attached to a molded, fibrous armor plate (31 four-ply) (0°/90°/0°/90° layers of a non-woven polyethylene fabric in a polyurethane matrix; molded at 270° F. and 2700 PSI) commercially available from Honeywell International Inc., of Morristown, N.J. Each plate was a 6"×6" square and having an areal density of 1.63 lb/ft$^2$ (psf). The backing material and armor plate were attached to each other with double-sided adhesive tape (Tesa® Reinforced DS tape; Areal Density=0.048 psf).

All samples were shot per the standard outlined by NIJ Standard 0101.04, Type IIIA, where a sample is placed in contact with the surface of a deformable clay backing material. All samples were shot once with a 9 mm, 124-grain Full Metal Jacket (FMJ) RN projectile at 1430 feet/second (fps) ±30 fps with the armor plate positioned as the strike face and with the backing material positioned directly on the clay surface. In Comparative Examples 18 and 19 which used no backing material, the armor plate was positioned directly on the clay surface. The projectile impact caused a depression in the clay behind the sample, identified as the backface signature (BFS). The BFS measurements for each example are identified in Table 2.

TABLE 1

| Example | Backing | Backing Areal Density (psf) | Total Sample Areal Density (psf) | Total Sample Thickness (in) |
|---|---|---|---|---|
| 1 (Comp) | McMaster-Carr B43NES-SE | 0.157 | 1.846 | 0.5598 |
| 2 (Comp) | McMaster-Carr B43NES-SE | 0.157 | 1.836 | 0.5466 |
| 3 (Comp) | McMaster-Carr B43NES-SE | 0.157 | 1.854 | 0.5475 |

TABLE 1-continued

| Example | Backing | Backing Areal Density (psf) | Total Sample Areal Density (psf) | Total Sample Thickness (in) |
|---|---|---|---|---|
| 4 (Comp) | (2X) United Foam XRD 15 PCF | 0.338 | 2.016 | 0.5714 |
| 5 (Comp) | (2X) United Foam XRD 15 PCF | 0.338 | 2.040 | 0.5755 |
| 6 (Comp) | (2X) United Foam XRD 15 PCF | 0.338 | 1.992 | 0.5735 |
| 7 (Comp) | Adhesive Backed Open Cell Foam | 0.266 | 1.866 | 0.5520 |
| 8 (Comp) | Adhesive Backed Open Cell Foam | 0.266 | 1.888 | 0.5570 |
| 9 (Comp) | Adhesive Backed Open Cell Foam | 0.266 | 1.934 | 0.5606 |
| 10 | NanoPore Insulation | 0.328 | 1.960 | 0.6165 |
| 11 | NanoPore Insulation | 0.328 | 2.039 | 0.6290 |
| 12 | NanoPore Insulation | 0.328 | 2.018 | 0.6210 |
| 13 (Comp) | Supracor Honeycomb, A2 0.25 CELL/E0000139 | 0.124 | 1.802 | 0.5235 |
| 14 (Comp) | Non-woven PE fabric armor | 1.000 | 2.682 | 0.5535 |
| 15 (Comp) | Non-woven PE fabric armor | 1.000 | 2.656 | 0.5497 |
| 16 (Comp) | Supracor Honeycomb, ST8508, 0.187 CELL, ST05X2/E0000139 | 0.190 | 1.868 | 0.5315 |
| 17 (Comp) | Supracor Honeycomb, SU8508, 0.25 CELL SU05X2/E0000139 | 0.148 | 1.826 | 0.5106 |
| 18 (Comp) | None | 0.000 | 1.630 | 0.3260 |
| 19 (Comp) | None | 0.000 | 1.630 | 0.3250 |

TABLE 2

| Example | Backing | BFS Depth (mm) | BFS Width (mm) | BFS Height (mm) |
|---|---|---|---|---|
| 1 (Comp) | McMaster-Carr B43NES-SE | 28.1 | 59 | 60 |
| 2 (Comp) | McMaster-Carr B43NES-SE | 28.4 | 72 | 64 |
| 3 (Comp) | McMaster-Carr B43NES-SE | 25.5 | 66 | 65 |
| 4 (Comp) | (2X) United Foam XRD 15 PCF | 27.7 | 65 | 63 |
| 5 (Comp) | (2X) United Foam XRD 15 PCF | 26.1 | 69 | 63 |
| 6 (Comp) | (2X) United Foam XRD 15 PCF | 27.2 | 66 | 65 |
| 7 (Comp) | Adhesive Backed Open Cell Foam | 30.1 | 73 | 70 |
| 8 (Comp) | Adhesive Backed Open Cell Foam | 26.4 | 70 | 68 |
| 9 (Comp) | Adhesive Backed Open Cell Foam | 27.9 | 68 | 65 |
| 10 | NanoPore Insulation | 19.1 | 53 | 50 |
| 11 | NanoPore Insulation | 18.8 | 55 | 53 |
| 12 | NanoPore Insulation | 23.7 | 61 | 63 |
| 13 (Comp) | Supracor Honeycomb, A2 0.25 CELL/E0000139 | 27.1 | 80 | 60 |
| 14 (Comp) | Non-woven PE fabric armor | 31.1 | 70 | 70 |
| 15 (Comp) | Non-woven PE fabric armor | 29.2 | 73 | 74 |
| 16 (Comp) | Supracor Honeycomb, ST8508, 0.187 CELL, ST05X2/E0000139 | 27.3 | 60 | 60 |
| 17 (Comp) | Supracor Honeycomb, SU8508, 0.25 CELL SU05X2/E0000139 | 28.3 | 74 | 60 |
| 18 (Comp) | None | 34.4 | 70 | 66 |
| 19 (Comp) | None | 34.4 | 70 | 65 |

CONCLUSIONS

As illustrated by the data in Table 2, Inventive Examples 10-12 using the NanoPore vacuum panel as a backing material had significantly lower measured 9 mm BFS (improved BFS performance) compared to samples tested with any other backing material or no backing material. The average 9 mm BFS for the three Inventive Examples was 20.5 mm. The average 9 mm BFS for Comparative Examples 1-3 which used the McMaster-Carr Neoprene/EPDM/SBr closed cell foam as a backing material was 27.3 mm. The average 9 mm BFS for Comparative Examples 4-6 which used the United Foam irradiated cross-linked polyethylene closed cell foam as a backing material was 27.0 mm. The average 9 mm BFS for Comparative Examples 7-9 which used the adhesive backed, water-resistant, super-cushioning open cell polyurethane foam as a backing material was 28.1 mm. The 9 mm BFS for Comparative Example 13 which used the Supracor flexible, closed cell honeycomb as a backing material was 27.1 mm. The average 9 mm BFS for Comparative Examples 14-15 which used the Honeywell proprietary non-woven PE fabric armor as a backing material was 30.15 mm. The 9 mm BFS for Comparative Example 16 which used the Supracor flexible, open cell honeycomb material as a backing material was 27.3 mm. The 9 mm BFS for Comparative Example 17 which used the Supracor flexible, open cell honeycomb material as a backing material was 28.3 mm. The average 9 mm BFS for Comparative Examples 18-19 which were tested without using a backing material performed the worst, with an average BFS of 34.4 mm.

Figure 9:
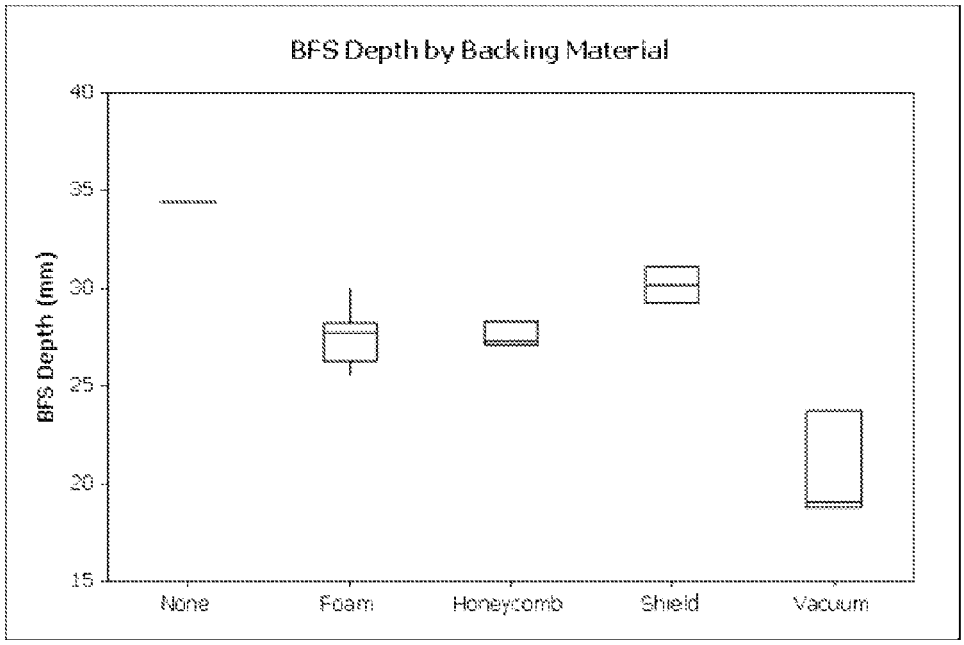
FIG. 9 is a graphical representation of the backface signature data from the examples as summarized in Table 2.

The BFS depth data as summarized in Table 2 is illustrated graphically in FIG. 9. As shown in FIG. 9, the closest in average 9 mm BFS performance to the vacuum panel backed composites of the invention was the irradiated cross-linked polyethylene closed cell foam of Comparative Examples 4-6, having an average 9 mm BFS of 27.0 mm, which is 31.7% (6.5 mm) greater than the average 9 mm BFS of 20.5 mm achieved by the present invention. Without averaging the data, comparing the best comparative sample result (Comparative Example 5 at 26.1 mm) with the worst inventive sample result (Example 12 at 23.7 mm) yields an improvement of 2.4 mm of more than 10%.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant article comprising:

a) a vacuum panel having first and second surfaces, said vacuum panel comprising an enclosure and an interior volume defined by the enclosure, wherein at least a portion of said interior volume is unoccupied space and wherein said interior volume is under vacuum pressure; and b) at least one ballistic resistant substrate directly coupled with at least one of said first and second surfaces of said vacuum panel, said substrate comprising fibers and/or tapes having a tenacity of about 7 g/denier or more and a tensile modulus of about 150 g/denier or more, or wherein said substrate comprises a rigid, non-fiber based, non-tape based material.

2. The article of claim 1 wherein said vacuum panel further comprises a supporting structure within said interior volume.

3. The article of claim 2 wherein said interior volume is predominantly unoccupied space.

4. The article of claim 1 wherein said enclosure comprises a sealed, flexible polymeric envelope.

5. The article of claim 1 wherein said vacuum panel has a depth of at least about ¼ inch (0.635 cm).

6. The article of claim 1 wherein at least one ballistic resistant substrate is directly attached to at least one of said first and second surfaces of said vacuum panel with an adhesive.

7. The article of claim 1 wherein at least one ballistic resistant substrate is directly attached to both said first surface and second surfaces of said vacuum panel.

8. The article of claim 1 wherein at least one ballistic resistant substrate is indirectly coupled with at least one of said first and second surfaces of said vacuum panel, wherein a foil layer is present between said ballistic resistant substrate and said vacuum panel.

9. The article of claim 1 wherein a plurality of vacuum panels are coupled with each ballistic resistant substrate.

10. The article of claim 1 wherein said ballistic resistant substrate comprises fibers having surfaces that are at least partially covered with a polymeric binder material.

11. A ballistic resistant article comprising:

a) a vacuum panel having first and second surfaces, said vacuum panel comprising an enclosure and an interior volume defined by the enclosure, wherein at least a portion of said interior volume is unoccupied space and wherein said interior volume is under vacuum pressure; and b) at least one ballistic resistant substrate directly or indirectly coupled with at least one of said first and second surfaces of said vacuum panel, said substrate comprising fibers and/or tapes having a tenacity of about 7 g/denier or more and a tensile modulus of about 150 g/denier or more, or wherein said substrate comprises a rigid, non-fiber based, non-tape based material, wherein said at least one ballistic resistant substrate is positioned as the strike face of the ballistic resistant article and said vacuum panel is positioned behind said at least one ballistic resistant substrate to receive any shock wave that initiates from an impact of a projectile with said at least one ballistic resistant substrate.

12. The ballistic resistant article of claim 11 wherein said enclosure comprises a sealed, flexible polymeric envelope.

13. The article of claim 1 wherein said ballistic resistant substrate has an areal density of from about 0.5 $lb/ft^2$ to about 8.0 $lb/ft^2$.

14. The ballistic resistant article of claim 11 wherein said rigid material comprises a ceramic material, glass, metal, a metal-filled composite, a ceramic-filled composite, a glass-filled composite, a cermet material, or a combination thereof.

15. The ballistic resistant article of claim 11 wherein said rigid material comprises steel, an aluminum alloy, titanium or a combination thereof.

16. The ballistic resistant article of claim 11 wherein said vacuum panel further comprises a supporting structure within said interior volume.

17. The ballistic resistant article of claim 16 wherein said interior volume is predominantly unoccupied space.

18. The ballistic resistant article of claim 11 wherein said vacuum panel has a depth of at least about ¼ inch (0.635 cm).

19. The ballistic resistant article of claim 11 wherein at least one ballistic resistant substrate is directly attached to at least one of said first and second surfaces of said vacuum panel.

20. A method of forming a ballistic resistant article which comprises:

a) providing a vacuum panel having first and second surfaces, said vacuum panel comprising an enclosure and an interior volume defined by the enclosure, wherein at least a portion of said interior volume is unoccupied space and wherein said interior volume is under vacuum pressure; and b) coupling at least one ballistic resistant substrate with at least one of said first and second surfaces of said vacuum panel, said substrate comprising fibers and/or tapes having a tenacity of about 7 g/denier or more and a tensile modulus of about 150 g/denier or more, or wherein said substrate comprises a rigid, non-fiber based, non-tape based material;

wherein said at least one ballistic resistant substrate is positioned as the strike face of the ballistic resistant article and said vacuum panel is positioned behind said at least one ballistic resistant substrate to receive any shock wave that initiates from an impact of a projectile with said at least one ballistic resistant substrate.

* * * * *